US005256256A

United States Patent [19]

Autio

[11] Patent Number: 5,256,256

[45] **Date of Patent: * Oct. 26, 1993**

[54] FRAME CONSTRUCTION FOR A PRESS SECTION OF A PAPER MACHINE

[75] Inventor: Markku Autio, Jyvaskyla, Finland

[73] Assignee: Valmet Paper Machinery Inc., Finland

[ * ] Notice: The portion of the term of this patent subsequent to Sep. 17, 2008 has been disclaimed.

[21] Appl. No.: 758,763

[22] Filed: Sep. 12, 1991

Related U.S. Application Data

[63] Continuation of Ser. No. 490,753, Mar. 8, 1990, Pat. No. 5,049,239, which is a continuation-in-part of Ser. No. 181,739, Apr. 14, 1988, abandoned.

[30] Foreign Application Priority Data

Apr. 14, 1987 [FI] Finland ..... 871649

[51] Int. Cl.[5] ..... D21F 3/04

[52] U.S. Cl. ..... 162/274; 162/360.3

[58] Field of Search ..... 162/360.1, 272, 273, 162/274, 358, 360.3, 358.1

[56] References Cited

U.S. PATENT DOCUMENTS

| | | | |
|---|---|---|---|
| 4,608,125 | 8/1986 | Autio | 162/273 |
| 4,657,634 | 4/1987 | Autio | 162/199 |
| 4,909,905 | 3/1990 | Ilmarinen et al. | 162/360.1 |
| 4,919,762 | 4/1990 | Laapotti et al. | 162/360.1 |

*Primary Examiner*—Karen M. Hastings
*Attorney, Agent, or Firm*—Steinberg & Raskin

[57] ABSTRACT

Frame construction for a press section of a paper machine which comprises, in a direction of running of a paper web, first a front frame and then a separate rear frame. On the front and rear frame, press rolls are mounted, at least some of which belonging to a compact press roll combination in which there are press nips between the press rolls and through which press fabrics are passed. With a view to facilitating replacement of press rolls and fabrics, the frame construction comprises a space which is situated between the front frame and the rear frame which are not connected together, and above the press roll combination. This space is constantly at least partially open, through which the different press rolls in the combination can be replaced. This space also facilitates replacement of the press fabrics provided in conjunction therewith. Another embodiment of the invention discloses an openable connection between the front and an intermediate frame.

32 Claims, 4 Drawing Sheets

FRAME CONSTRUCTION FOR A PRESS SECTION OF A PAPER MACHINE

This is a continuation of application Ser. No. 07/490,753, filed Mar. 8, 1990, (now U.S. Pat. No. 5,049,239, which is a continuation-in-part of application Ser. No. 07/181,739, filed Apr. 14, 1988 (now abandoned).

BACKGROUND OF THE INVENTION

The present invention concerns a frame structure or construction for a press section of a paper machine which comprises, in a running direction of a paper web therethrough, first a front frame and then a separate rear frame, with press rolls being mounted on the front and rear frames, at least some of which belonging to a compact press roll combination in which there are press nips between the press rolls through which press fabrics are passed.

In prior art compact press sections of a paper machine, such as the Valmet so-called Sym-Press (TM) press section, there have been horizontal beams above the press rolls both at the service side and at the operating side of the paper machine, which connect the front frame and the rear frame of the press section permanently together. In this connection, and also in the following description, the front frame means the frame part that is placed in the direction of running of the web before the compact press roll combination, with a suction roll of the press, e.g., being fixed to the front frame. In a corresponding manner, the rear frame means the frame part placed after the press roll combination.

Difficulties have occurred with respect to replacement both of press fabrics and of press rolls in connection with the prior art frame parts of the press sections. These problems have increased with increase in the widths of the paper machines, in particular due to the fact that the pres rolls have become increasingly longer and heavier. These problems have also been increased by the fact that press fabrics which are made of plastic material and which are rigid over a transverse direction, have started to be used more increasingly. Such press fabrics cannot be jammed into a bundle, because it would thereby become wrinkled and unusable.

Beloit Corporation has attempted to solve the problems described above by means of a so-called "Flip-top" (trademark of Beloit Corporation) frame construction. In this prior art frame solution for a press section, a top frame is used which is provided with a pivot shaft parallel to a transverse direction of the paper machine and placed above the press rolls, whereby either the top part of the front frame or the top part of the rear frame can be opened around the pivot shaft. The two top parts of the frame cannot be opened at the same time. By opening the top part of the front frame, it is possible to facilitate the replacement of the pick-up fabric of the press section and the replacement of the fabric that usually acts as the press fabric in the first nip and in the second nip. The top part of the rear frame is locked thereat, with opening-dumping of the top part of the front frame taking place on support of the rear frame.

Correspondingly, when the top part of the front frame is in the closed-locked position, the top part of the rear frame can be opened or "dumped" so that the press fabric of the third press nip can be replaced. The lower fabric of the first nip, which principally runs in the basement space or area, is replaced by means of arrangements known in and of themselves. The above "Flip-top" solution can be characterized as a sort of "drawbridge" which is opened around an articulated joint expressly situated at a middle of the bridge, while only one half of the bridge can be opened at a time.

Frame constructions for press sections are known from the Valmet Finnish Patent Applications Nos. 844693 (U.S. Pat. Nos. 4,699,692 and 4,608,125) and 854959, in which the front frame and the rear frame are connected to each other and/or to the intermediate frame of the central roll in the press by means of various openable and closeable intermediate frames. Such openable and closeable intermediate frames are usable in themselves, but they increase the cost of manufacture of the frame part because relatively massive frame components must be provided with articulated joints and with means for opening and closing. When compact press roll arrangements are used, problems of space are also encountered because several different press rolls with the auxiliary devices thereof must be accommodated in relatively limited space. This is why it has been necessary to place the frame parts that connect the front frame and the rear frame to each other or to the intermediate frame with the opening and closing means thereof in highly congested spaces, which results in difficulties both for construction and for operation.

SUMMARY OF THE INVENTION

Accordingly, it is an object of the present invention to provide improvement over the above-noted arrangements and to eliminate the problems and difficulties associated therewith.

These and other objects are attained by the present invention which is directed to a frame structure for a press section of a paper machine comprising, in a running direction of a paper web through the press section, a front frame and a rear frame separate from the front frame, with press rolls being mounted on the front and rear frames. At least some of the press rolls form a compact press roll combination in which there are press nips through which press nip fabric is passed. The front and rear frames, which are not connected together, define a space therebetween and above the press roll combination, this space being constantly at least partially open. The press rolls of the press combination are replaceable through the space which also facilitates replacement of the press fabric.

With a view to achieving the objects noted above and those which will become apparent below, and with a view to facilitating replacement of press rolls and press fabrics, a frame construction in accordance with the present invention is principally characterized by a space being placed or situated between a front frame and a rear frame which are not connected together and above a press roll combination, such space being constantly at least partially open. The press rolls in the combination can be replaced through this space, which also facilitates the replacement of the press fabrics provided in connection therewith.

According to the present invention, separate front and rear frames which are not connected to each other are used, so that a constantly open or openable space remains above the compact press roll arrangement which is not closed at all. The front frame and the rear frame are not connected to each other or to an intermediate frame at any stage, at least not by strong and expansive frame parts proper. If required, the open space can be made wider by arranging the foremost guide roll of a second upper fabric journaled on the intermediate frame and detachable as well as displaceable to an inner position in connection with replacement of press rolls or of the second upper fabric.

Moreover, a press roll mounted on the rear frame which is usually the uppermost press roll, is preferably mounted on an articulated intermediate frame which can be dumped or opened at a front part of the rear frame to an inner position so that an even wider free space is opened for replacement of the press rolls and/or different fabrics.

A central roll in the press may be supported directly or through an intermediate part on a front part of the rear frame, or on a particular intermediate frame which is separate from the front frame. This intermediate frame is also separate from the rear frame when a nip separate from the compact press roll arrangement is provided. Furthermore, the intermediate frame is either separate from or connected to the front side of the rear frame when such a separate press nip is not provided.

This intermediate frame may be placed between lower parts of the front and rear frames below the open space. The central roll of the press roll combination or an equivalent press roll may be mounted stationarily or permanently on a top part of this intermediate frame.

A press section in accordance with the present invention can be applied, e.g., in connection with the Valmet Sym-Press I or Sym-Press II press sections, as well as in other corresponding closed press sections.

When a frame part of a press in accordance with the present invention is applied, the front frame and the rear frame are separately dimensioned to be sufficiently rigid in view of various phenomena of vibration. Recently, it has been surprisingly noted that connecting the front frame and the rear frame by means of an intermediate frame does not reduce the tendencies of vibration of the frame parts, at least not to a decisive extent.

In connection with the frame parts in accordance with the present invention, it is possible to use either press fabrics in the form of a closed loop, preferably plastic fabrics, or so-called seamable press fabrics in which case openable and closeable intemediate pieces are not necessarily required in connection with the side frames of the frame parts, making the frame construction simpler and less expensive. Another Embodiment of the invention discloses an openable connection between the front frame and in intermediate frame.

BRIEF DESCRIPTION OF THE DRAWING

The present invention will be described in greater detail below, with reference to an exemplary embodiment thereof illustrated in the accompanying Figures, and to which the present invention is not intended to be strictly confined. In the drawing.

DESCRIPTION OF THE PREFERRED EMBODIMENTS

Figure 1:
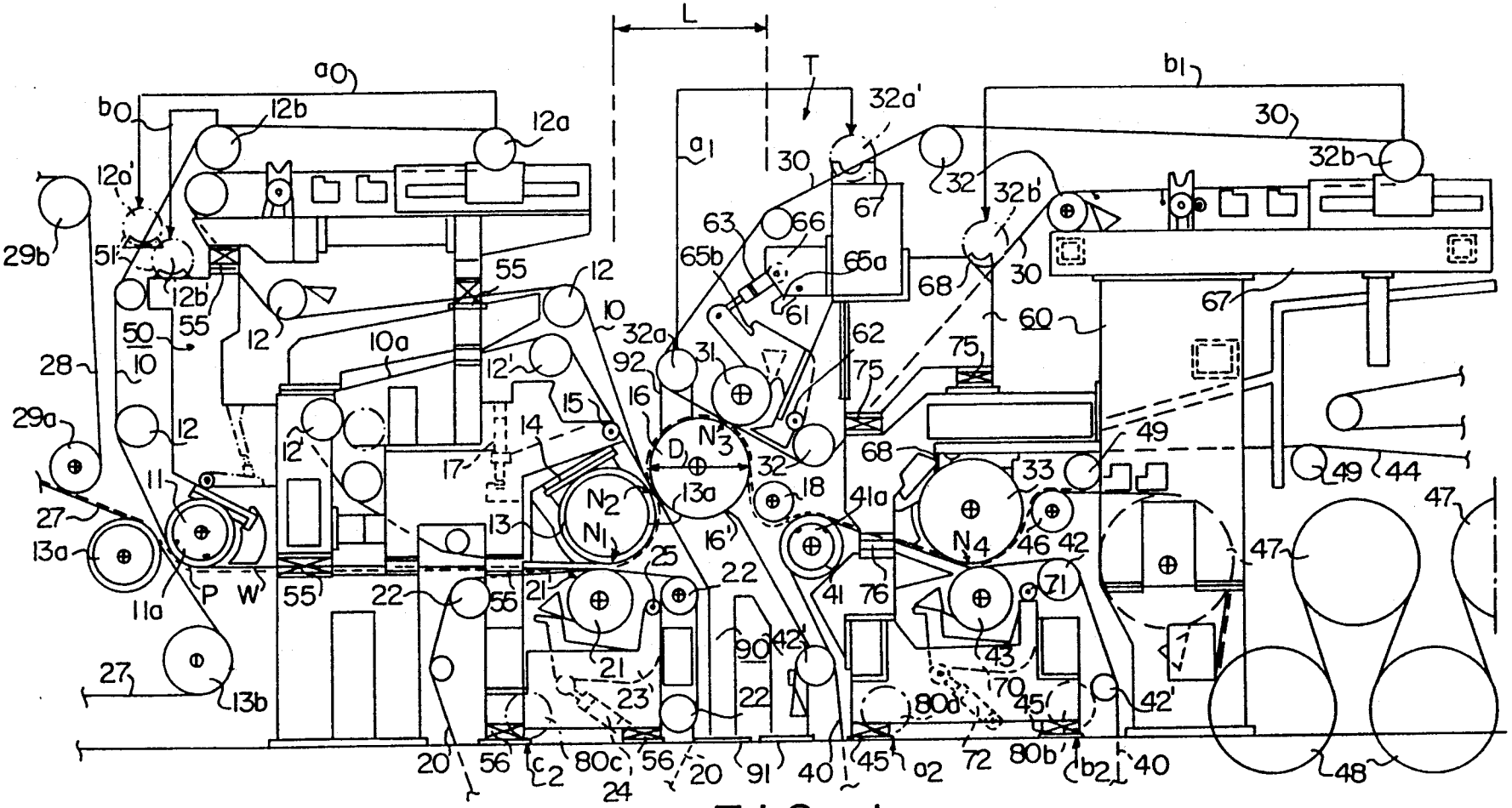
FIG. 1 is a schematic side view of a paper machine press section provided with a frame construction in accordance with the present invention.

A press section shown in FIG. 1 comprises a closed press roll combination 13, 16, 21, 31 with the press rolls thereof forming three press nips $N_1$, $N_2$ and $N_3$ which remove water from a web W between the rolls. Moreover, the press section includes a fourth, separate nip $N_4$ which is formed between press rolls 33 and 43. The press section comprises a first upper fabric 10 and a first lower fabric 20 (as a rule, felts), both of which run through the first nip $N_1$ with the first fabric 10 acting as a pick-up fabric and also as a press fabric in the second nip $N_2$. A second upper fabric 30 runs through the third nip $N_3$, while a fourth press fabric 40 which is a lower fabric, acts as the lower press fabric in the fourth nip $N_4$.

Inside the loop of the first fabric 10, there is a pick-up roll 11 provided with a suction zone 11*a* and transferring the web W from the forming wire 27 to the run between the rolls 13*a* and 13*b*. The figure also shows a part of an upper wire 28 and its guide rolls 29*a* and 29*b*. The fabric 10 is guided by guide rolls 12, 12*a*, 12*b*. The lower fabric 20 runs as guided by guide rolls 22. Correspondingly the second upper fabric 30 is guided by guide rolls 32, 32*a*, 32*b*. The fourth fabric 40 which transfers the web W from a transfer roll 18 into the last nip $N_4$ runs as guided by suction-transfer rolls 41 and 42 as well as by guide rolls 42'.

As is shown in the figure, a second fabric 10*a* is arranged inside the first upper fabric 10 which has a smaller loop and which is guided by guide rolls 12'.

A lower roll 21 of the first nip $N_1$ is mounted on an intermediate part 23 which is attached to a front frame 50 by means of pivot shafts 25. The intermediate part 23 can be pivoted by means of hydraulic cylinders 24, by means of which it is also possible to provide loading of the nip $N_1$.

A suction roll 13 in the press is mounted on an intermediate part 14 which is also mounted by means of pivot shafts on the front frame 50, preferably at an outermost point thereof.

The front frame 50 is provided with intermediate pieces 55. When the intermediate pieces 55 are opened and the front frame 50 is cantilevered, the upper fabric 10 can be replaced. In connection with the replacement, the nips $N_1$ and $N_2$ are opened. For the replacement of the upper fabric 30, a rear frame 60 is provided with intermediate pieces 75. Correspondingly, the rear frame 60 is provided with an intermediate piece 76 for the replacement of the fourth fabric 40.

An upper roll 33 in the fourth nip $N_4$ is mounted from above on the rear frame 60 through frame parts 68. A lower roll 43 in the fourth nip $N_4$ is mounted on an intermediate part 70 which is attached to the rear frame 60 by means of pivot shafts 71. The intermediate part 70 can be pivoted by means of hydraulic cylinders 72 so as to open and to load the nip $N_4$.

A press roll 31 in the third nip $N_3$ is mounted on an intermediate part 61 which is attached to a front part of the rear frame 60 by means of pivot shaft 62. The intermediate part 61 can be pivoted by means of hydraulic cylinders 63 to an upper position so as to open the nip $N_3$ and to replace the third fabric 30. In connection with the replacement of the fabric 30, the intermediate part 61 can be locked in connection with a projection part 66 of the rear frame 60 by means of locking devices 65*a* and 65*b*.

The foremost guide roll 32a of the third fabric 30 is mounted on a frame part 92 which is fixed in connection with an intermediate frame 90 and above the same, preferably in connection with an upper part of the bearing supports of a central roll 16.

The passage of the web W starting from the pick-up point P is as follows. A suction sector 11a of the pick-up roll 11 detaches the web W from the wire 27 and causes it to adhere to a lower face of the fabric 10 on which the web W passes through the two-felt nip $N_1$. The lower roll 21 in the nip $N_1$ is provided with a hollow face 21'. After the nip $N_1$, the web W follows along with the first upper fabric 10 by the effect of a suction sector 13a of the suction roll 13. In the second nip $N_2$, the web W is transferred onto the face of the smooth-faced 16' center roll 16, e.g. a rock roll, and further into the third nip $N_3$, after which the web W follows along with the center roll 16 and, being guided by a transfer roll 18, is transferred onto the fabric 40 over a suction sector 41a of a suction roll 41 and, being supported by the fabric 40, further into the nip $N_4$.

After the nip $N_4$, the web W follows along with the smooth-faced press roll 33, from which it is transferred onto an alignment roll 46 and onto a single-draw fabric 44 in a drying section, the fabric 44 being guided by guide rolls 49. The web W is passed as a single-fabric draw into the drying section, of which three upper cylinders 47 and two lower cylinders 48 are shown in FIG. 1.

The press-section frame construction in accordance with the present invention comprises a front frame 50 and a fully separate rear frame 60 which is not connected to the front frame 50. The front frame 50 and rear frame 60 are separated in a manner such that they are separated by a space T open at the top. This space T can be utilized in accordance with the present invention for replacement of the press rolls 13, 16, 21 and 31. The open space T also facilitates replacement of the upper fabrics 10 and 30. The present invention is also suitable for use in such press in which, in connection with the central roll 16, there are two nips with fabrics of their own.

The separate frame parts 50 and 60 in accordance with the present invention are formed so that, even when separated, they are sufficiently rigid, e.g., in view of various vibration phenomena.

The press frame construction shown in FIG. 1 includes an intermediate frame 90 on which the central roll 16 in the compact press is supported and journaled. In FIG. 1, the intermediate frame 90 is separate from the front frame 50 and the rear frame 60 so that the lower fabric 20 and the fourth fabric 40 can be replaced. When a separate nip $N_4$ is used in addition to the compact press roll combination, an intermediate frame is preferably used which is separate from the front frame 50 and the rear frame 60 described above, so as to permit replacement of the lower fabric 40. In such case, the present invention can also be practiced so that the central roll 16 is supported on the front side of the rear frame 60 either directly or through a projection part or equivalent. In such a case, roll geometry must be modified to some extent as compared with what is shown in the figure, in particular with respect to the rolls 18, 31, 32 and 41. If a nip $N_4$ is not used, variation is also possible in which the intermediate frame 90 is connected to the rear frame 60 by means of horizontal beams or equivalent.

According to FIG. 1, the foremost guide roll 32a of the second upper fabric 30 is mounted on supports 92 which are also attached to bearing supports of the central roll 16 which, in turn, are attached to the intermediate frame 90. In other words, the foremost guide roll 32a of the second upper press fabric 30 in the press which runs through press nip $N_3$ placed in connection with the central roll 16, is mounted on stationary support parts 92 which are attached to upper parts of the intermediate frame 90 or equivalent, preferably to a top side of the bearing supports of the central roll 16. When the guide roll 32a is arranged to be detachable from its supports 92, a passage can be opened for replacement of the press rolls. Another, alternative mode which is clearly not equally advantageous for supporting the guide roll 32a, is to arrange the guide roll 32a in connection with the intermediate part 61 for the press roll 31. When the intermediate part 61 is then pivoted to the upper position, the guide roll 32a is shifted away from the path for the replacement of the press rolls. If necessary, the press roll 32a can even then be arranged to be detachable and displaceable to inner position 32a'.

Replacement of various fabrics and press rolls will be described below. When the first fabric 10 is being replaced, the intermediate pieces 55 and the pick-up point P as well as the press nips $N_1$, $N_2$ are opened, the latter nip $N_2$ by raising the intermediate frame 14 to the upper position by means of the hydraulic cylinders 17.

The guide roll 12a of the fabric 10 is then shifted along the path $a_0$ to the position 12a' at a parking site 51. Correspondingly, the second upper guide roll 12b is shifted along the path $b_0$ to the position 12b' at the parking site 51. The new fabric 10 can then be passed through the spaces made free by the intermediate pieces 55 to its position.

The upper fabric 30 is replaced as follows. The foremost guide roll 32a of the fabric 30 is detached from its supports 92 and shifted along the path $a_1$ to an inner upper position 32a' at a parking site 67. In other words, the guide roll 32a of the second upper fabric 30 is arranged to be detachable and displaceable in connection with the replacement of the second upper fabric 30 and/or the press rolls 13, 16, 21, 31 from operating position, by making use of the open space T between the front frame 50 and the rear frame 60, to the inner upper position 32a' at a parking site 67 in connection with the rear frame 60.

In a corresponding manner, the rearmost guide roll 32b of the upper fabric 30 is shifted along the path $b_1$ to an inner position 32b' at a parking site 68. The intermediate pieces 75 and the nip $N_3$ are opened by raising the intermediate part 61 by means of actuating devices 63 to the upper position. The new fabric 30 is then passed around the guide rolls to be placed inside the fabric through the spaces in the side frame that are allowed to remain free by the opened intermediate pieces 75. The new fabric 30 is hereupon spread out to its full length and, by shifting the guide rolls 32a' and 32b' to their normal operating positions, the nip $N_3$ is closed and the fabric 30 is tensioned.

The lower fabric 40 in the fourth nip is replaced by the intermediate pieces 45 being opened and the lower guide rolls of the fabric being shifted in the direction shown by the arrows $a_2$ and $b_2$ to the upper positions 80a and 80b, whereupon, through spaces made free by the opened intermediate pieces 45, a new fabric 40 is passed to its operating position while the nip $N_4$ is open. The rolls 80a and 80b are then shifted into the basement space to the lower positions thereof (not illustrated). In a corresponding manner, the second fabric 20 is replaced by opening intermediate pieces 56 and by shifting a lower guide roll 80c to an upper position in the direction shown by arrow $c_2$. When the nip $N_1$ is opened, the new fabric 20 is placed as suitably spread out around its guide rolls, and the guide roll 80c is shifted into the basement space to its lower position (not illustrated).

The press rolls 13, 16, 21, and 31 are replaced as follows, by making use of the open space T remaining between the separate frame parts 50 and 60. In connection with the replacement of these rolls, the upper fabrics 10 and 30 have been removed. The guide roll 32a of the second upper fabric 30 is detached from its supports and shifted to an upper position 32a' at the parking site 67. The intermediate frame 61 is pivoted to the upper position and fixed in that position by means of the locking devices 65a and 65b. The press roll 31 can then be lifted freely, by means of a crane through the open space T. If required, the central roll 16 can also be detached and lifted directly, without any lateral shifting, by making use of the open space T, and by means of the traverse crane (not illustrated) of the paper machine hall.

The suction roll 13 can also be lifted, initially through the space between the front frame 50 and the intermediate frame 90, and thereupon through the open space T between the front frame 50 and the rear frame 60. The press roll 21 can also be lifted in the upper manner, after the rolls 31, 16 and 13 have been displaced and after the lower fabric 20 has been removed.

The outermost point of the front frame 50 is placed at the pivot shafts 15 of the intermediate frame 14 of the suction roll 13. In a corresponding manner, the outermost point of the rear frame 60 is placed at a front side of the projection part 66. If the outermost points are taken into account, then the construction is preferably arranged such that a center of rotation of the central roll is situated substantially halfway between the outermost points in a horizontal direction. In other words, the fully opened free space T is placed exactly above the central roll 16. A center of rotation of the central roll 16 in the press roll combination 13, 16, 21, 31, is preferably placed substantially in a middle area of the free space T in the running direction of the web W.

In FIG. 1, a width of the open space T is denoted by L. This width is calculated as a substantially horizontal distance in a machine direction between the outermost point of the front frame 50 which is situated at the pivot shafts 15 of the intermediate frame 14, and the outermost point of the rear frame 60 which is situated at the front side of the projection part 66 of the rear frame 60. According to the present invention, the front frame 50 and the rear frame 60 are fitted in relation to one another and dimensioned so that the width L of free space T is somewhat larger than the maximum diameter of the press rolls, which is the diameter D of the central roll 16 in the figure. As a rule, $L=kD$, wherein k is within the range of about 1.1 to 2.0, preferably k=about 1.4 to 1.7.

When a sufficiently wide free space T is used in accordance with the present invention, at least the central roll 16, whose weight may be up to about 70,000 kgs., can be lifted directly without any lateral shifting, which might cause dangerous swinging and risk of damage to the central roll 16. A sufficiently wide (L) free space also facilitates replacement of the relatively massive suction roll 13 and of the other parts. When the press rolls 13, 16, 21 and 31 are lifted, it is possible to use either lifting by the axle journals or so-called center lifting which means that the roll is suspended on only one crane hook by means of lifting lines which support the roll in downwardly open V-form symmetrically at both sides of the vertical center plane. It is an advantage of center lifting that the roll can be turned in the horizontal plane around its vertical center axis, which usually facilitates the shifting of the rolls even in the most congested premises. When a roll is lifted by means of its axle journals, the roll can usually only be shifted so that it retains its longitudinal direction, because the use of two cranes in joint operation is difficult and risky in view of safety at work. For the lifting of rolls, a normal traverse crane operating above the paper hall is used, as a rule.

The shifting of fresh rolls to their positions takes place by means of the open space T, and by carrying out the operations described above in the reversed order.

With respect to the various details of the replacements of fabrics and rolls, reference is made by way of example to the Valmet Finnish Patent Application No. 844693.

If seamable felts are used, then it is not necessary to provide the different frame parts with openable and closable intermediate pieces 55, 56, 45, 75, 76, because the fabrics can also be replaced without such pieces. In other words, the side frames of the front frame 50 and the rear frame 60 are fully closed and nonopenable, when seamable press fabrics are used in the press section.

Figure 2:
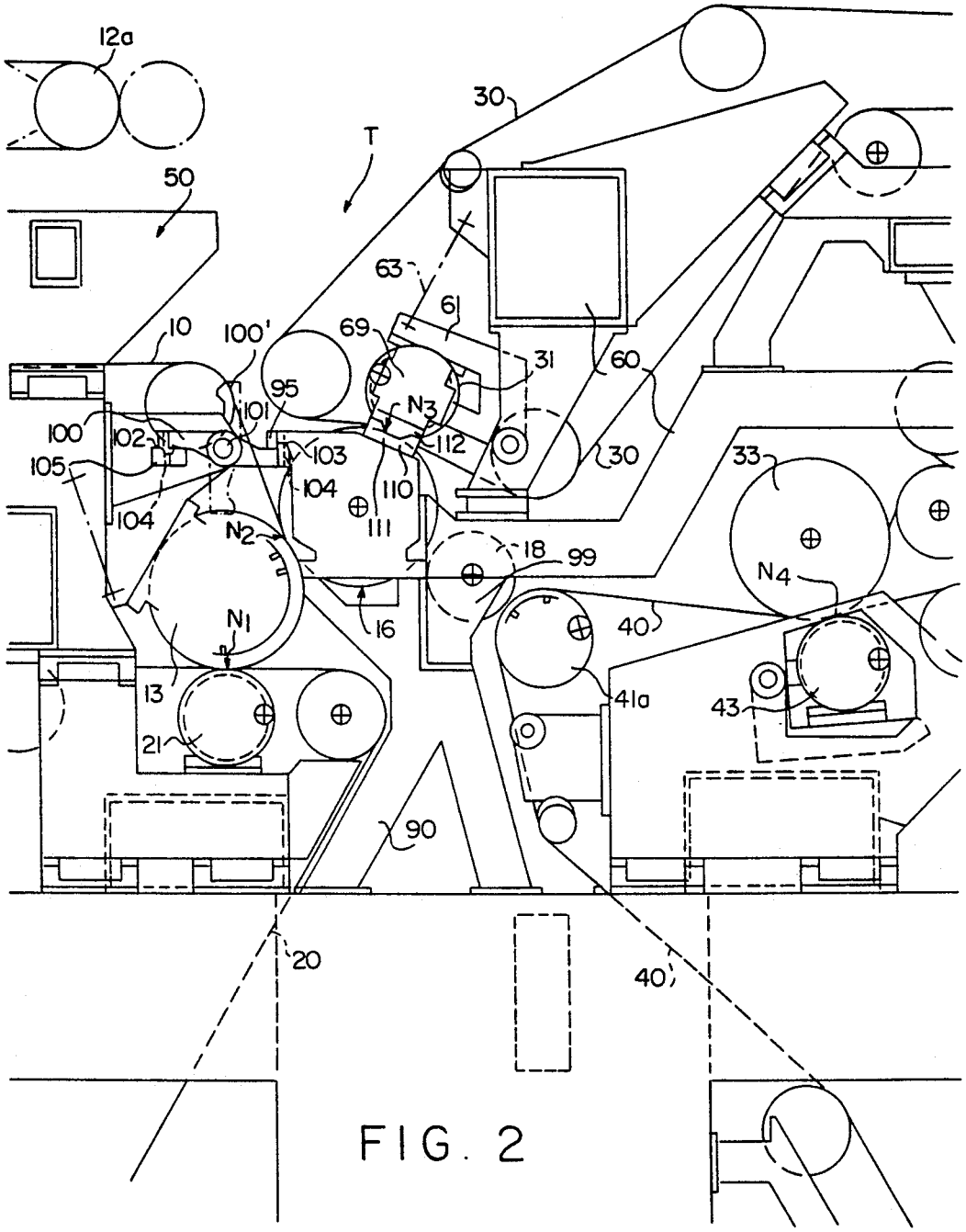
FIG. 2 is a schematic side view of another embodiment of the frame construction of the present invention disclosing an openable connection between the front frame and the intermediate frame.
Figure 3:
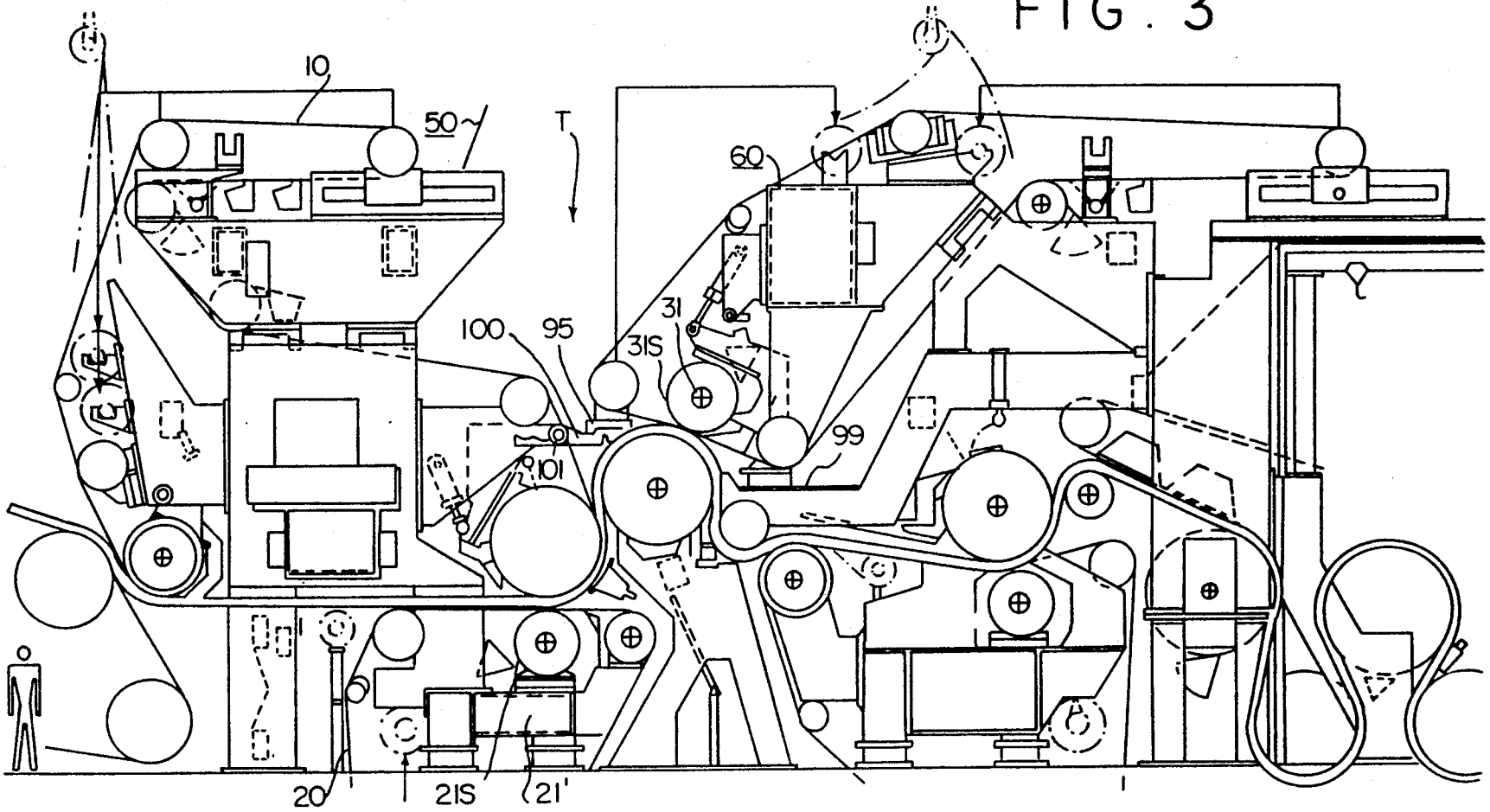
FIG. 3 is a more comprehensive schematic side view of the embodiment of the frame construction of the present invention shown in FIG. 2.
Figure 4:
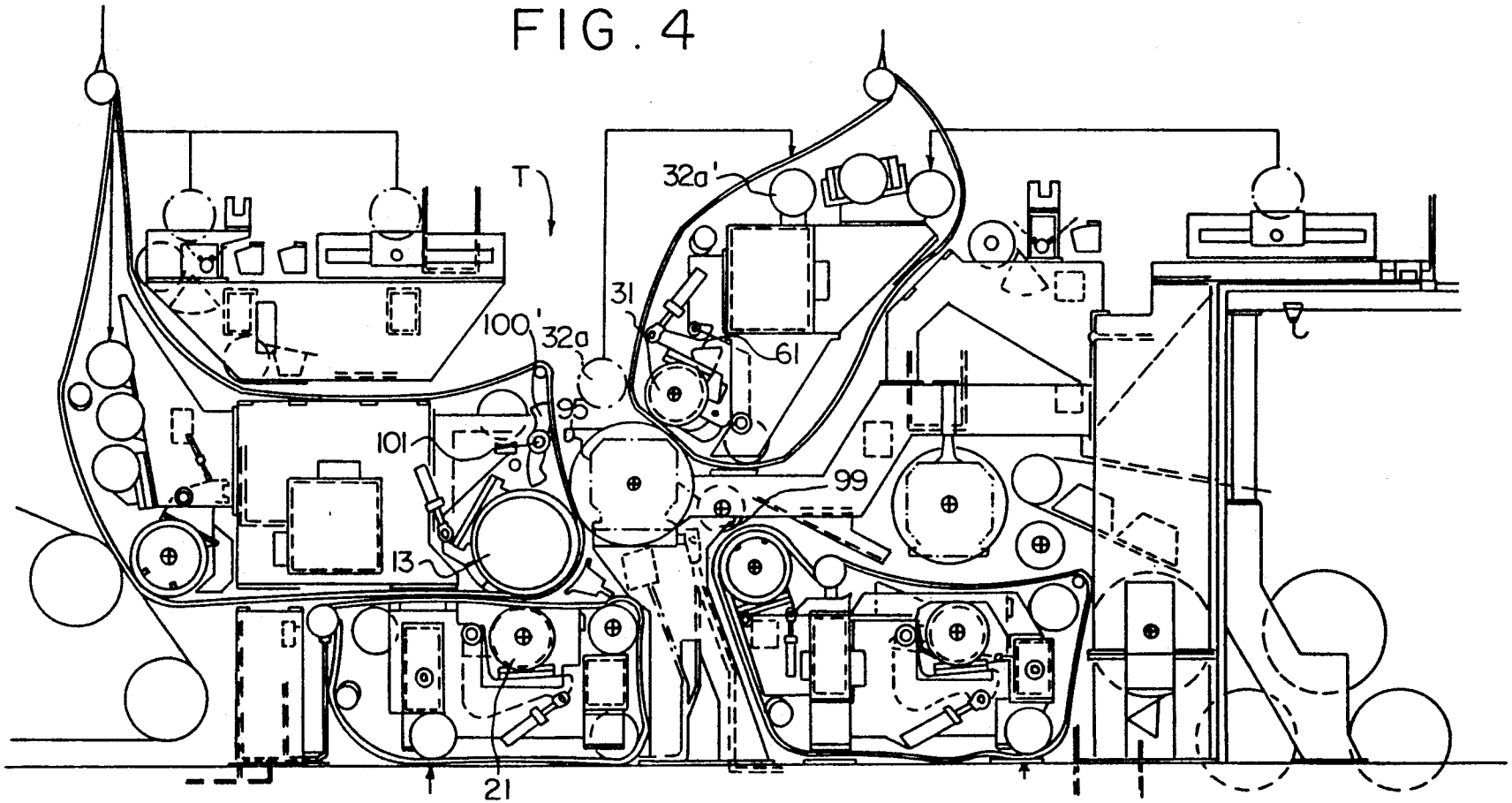
FIG. 4 is a schematic side view of the embodiment of the frame construction of FIG. 2 and 3 with the frame structure open such that the felt can be changed.

For FIGS. 2-4, elements which are identical are designated by the same reference numerals. According to FIGS. 2-4, the front frame 50 and the intermediate frame 90 are openably interconnected by means of a lever element 100 which is articulated to the front frame 50 so as to be pivotable between a closed operating position in which it interconnects the front frame and the intermediate frame, and an open position in which it is disconnected from the intermediate frame. In the embodiment of FIG. 2, the lever 100 is articulated, in conjunction with the projecting part of the front frame 50, by means of the horizontal transverse joint 101 attached thereto. This openable lever 100 is preferably only on the operating side of the machine. At the corresponding point on the driving side of the machine there is a fixed beam element. The lever 100 is openable so as to be in the open position 100' shown in FIG. 4 when the upper felt 10 (FIG. 3) is changed.

The opening of the lever 100 can also facilitate the changing of rolls because the lifting wire can be passed through it when the roll is moved in a lateral direction. Thus it is possible to use three hooks in a crane and, by changing the grip of the hooks, to move the roll in a transverse direction.

As shown in FIGS. 2-4, the front frame 50 and the intermediate frame 90 are interconnected by means of the lever 100 for the reason that this coupling enables vibration of the frames and the nips to be damped, and that the lever 100 is made to serve as a tension bar receiving loads of the second lever N2. Both ends of the lever 100 are provided with projection elements 102 and 103 fitting into mating elements, 105 and 95. The mating part 95 is in fixed connection with the bearing supports of the center roll 16. Eye-bolts 104 work in connection with the aforementioned elements 102, 105, and 103 to fix the lever 100 in a closed position.

An advantageous feature of the lever 100 is that it is connected b the articulated shaft 101 at its middle such that the lever is readily openable without need for any power devices after the aforementioned eyebolts 104 have been opened.

An advantageous feature of the structure shown in FIGS. 2 and 3 is that the lower roll 21 of the first nip has no loading arms. The opening movement of the nip is facilitated by the hydraulic elements or hydraulic shoe elements 21S disposed within the axle journals of the roll mantle or within the roll mantle without any need for external loading arms.

In FIG. 2 the bearing supports 69 of the arms 61 of the roll 31 are provided, at their undersides, with the projection part 112 coupled with the corresponding support parts 111 of the bearing supports of the central roll 16. The parts 111 and 112 constitute a "hydraulic" friction connection when the arms 61 are loaded by the hydraulic cylinder 63, and the power generated by the hydraulic cylinders must be greater than the loading of the nip $N_3$, which is provided by the hydraulically loaded shoes 31S disposed within the roll 31. The coupling 111, 112 is self-positioning and requires no locking members. Thus it is easily openable by cylinders 63. The purpose of the coupling 111, 112 is to connect the intermediate frame 90 and the rear frame to each other so that vibrations are reduced. The arms 61 are opened by the hydraulic cylinder 63 when the upper felt 30 and the center roll 16 are changed.

The center roll 16 is replaced through the open space T by lifting it in an upward direction. The center roll 16 is generally the heaviest roll, and may weigh 60,000–70,000 kilograms.

The combination of the connection 111/112, the connecting element 99 between the intermediate frame 90 and the rear frame 60, and the bearing supports of the center roll 16 achieves a closed circle with as small an area as possible in the region of the nip $N_3$ so that vibrations can be efficiently prevented. The abovementioned rolls 21 and 31 provided with internal loading pistons 21S, 31S are of the kind described, for instance, in the Applicant's European Patent Application EP 0 332 594 A2 filed Mar. 2, 1989.

FIG. 4 shows that a conventional recess-surfaced press roll is used for the aforementioned rolls 21 and 31.

The construction illustrated in FIGS. 2–4 provides a number of important advantages over the arrangement disclosed in the Applicant's aforementioned U.S. Pat. Nos. 4,699,692 and 4,608,125.

In the arrangements disclosed in the abovementioned U.S. patents, the center roll and the nips situated in conjunction therewith for the paper machine press section are susceptible to vibrations because they are not connected to the front or rear frames in any way. On the other hand, according to the invention the bearing supports for the center roll are connected by the lever 100 to the front frame 50 and by the coupling 111, 112 to the rear frame. Furthermore, the intermediate frame 90 is connected by the part 99 to the rear frame 60. In the arrangement of the aforementioned U.S. patents, and in similar constructions, there occur nip vibrations which have an adverse effect on the quality of paper and impair the durability of the press felt, because the vibrations make waves in the press felt, and barring is produced in the web for this reason also. The vibrations generated in the prior constructions and similar constructions and the barring of felts in them tend to reinforce themselves such that the vibration amplitudes increase with time, and consequently barring will be produced on the coating to the press rolls, also, which results in the press rolls having to be ground more frequently. "Barring" is a variation in the density or thickness extending longitudinally in the machine direction. "Barring" is caused by rapid vibration of rolls at a nip level, which causes variations in linear loads in press roll nips.

The various details of the present invention may vary within the scope of the inventive concepts set forth above, which have been described for the sake of example only. Therefore, the preceding description of the present invention is merely exemplary, and is not intended to limit the scope thereof in any way.

What is claimed is:

1. A press section of a paper machine, said press section comprising, in a running direction of a paper web through the press section;

a front frame, an intermediate frame having a central roll of a compact press roll combination mounted thereon; and a rear frame separate from and not permanently connected to said front frame, a plurality of press rolls mounted on said front and rear frames, at least some of which form said compact press roll combination in which there are press nips through which press fabric is passed, said compact press roll combination comprising said central roll and two other press rolls which each form a respective press nip with said central roll, wherein a space is formed between said frames and above the press roll combination, said space being constantly at least partially open or openable such that respective ones of said press rolls of said press roll combination are accessible for removal from said paper machine, the press rolls of the press combination being replaceable through said space which also facilitates replacement of the press fabric, and one of said press rolls being mounted on an intermediate part separate from said front frame and pivotally mounted upon said rear frame at a rear part of said open space and being pivotable by an actuating device to an upper position for replacement of press rolls or fabric, said intermediate part extending above said one of said press rolls and terminating approximately in the same vertical plane as the front of said one of said press rolls when it is in a position forming one of said nips with said central press roll, a lever element for openably interconnecting said front frame and said intermediate frame, said lever element being articulated to one of said front and intermediate frames so as to be pivotable between a closed operating position in which it interconnects said front and intermediate frames, and an open position in which it is disconnected from the other of said front and intermediate frames, such that an upper felt can be changed when said lever is in said open position, said lever element having first and second projection parts structured to respectively fit into first and second mating parts of said front and intermediate frames, said lever element having a pivot joint located approximately midway between said first and second projection parts.

2. The structure of claim 1, wherein said rear frame comprises a front part which directly supports the central roll of the press combination.

3. The structure of claim 1, wherein said rear frame comprises an intermediate member on a front portion thereof for supporting the central roll of the press combination.

4. The structure of claim 1, wherein said intermediate frame is connected to a front side of said rear frame.

5. The structure of claim 1, wherein said intermediate frame is situated between lower portions of said front and rear frames below said space, with said central roll being stationarily mounted on a top part of said intermediate frame.

6. The structure of claim 1, additionally comprising a stationary support mounted on an upper part of said intermediate frame, for supporting a guide roll of a fabric passing through a nip of the press roll combination.

7. The structure of claim 6, wherein said stationary support is attached to a top side of a bearing support for the central roll in turn attached to said intermediate frame.

8. The structure of claim 6, wherein the guide roll is detachably mounted upon said stationary support, said rear frame additionally comprises a parking site on which the guide roll is supported after detachment and displacement from said stationary support, and a path of displacement of the guide roll between said stationary support and parking site is defined in said open space, whereby the fabric, the guide roll for the fabric, and the central roll can then be replaced.

9. The structure of claim 1, further comprising;

a suction roll and wherein said suction roll and a first of said two other rolls define a first two-fabric press nip, said first roll being hollow-faced, said central roll which is smooth-faced and said suction roll defining a second press nip, and a second of said two other rolls being hollow-faced and defining a third press nip with an upper sector of said central roll.

10. The structure of claim 9, additionally comprising a first intermediate part pivotally mounted upon said front frame at a front part of said open space upon which the suction roll is mounted, a second intermediate part mounted upon said front frame and on which the first roll defining the first nip is mounted, and a third intermediate part pivotally mounted upon said rear frame at said rear part of said open space pivotally supporting the hollow-faced roll defining the third nip is mounted, with the central roll being stationarily mounted on a top portion of said intermediate frame.

11. The structure of claim 9, additionally comprising an intermediate member pivotally mounted on said rear frame through a pivot shaft for supporting a lower roll forming a separate nip from the compact press roll combination with an upper roll that is stationarily supported on said rear frame.

12. The combination of claim 9, further comprising a first fabric in the two-fabric nip which also serves as a pick-up fabric, a plurality of guide rolls for the first fabric which are mounted on said front frame which comprises a parking site to receive at least an uppermost one of the guide rolls which is displaceably mounted on said front frame, and wherein the other or lower fabric of the two-fabric nip and a guide roll therefor are raiseable to an upper position for replacing the lower fabric, and further comprising a guide roll for a fabric passing through the third nip which is mounted upon said intermediate frame.

13. The structure of claim 12, wherein said rear frame additionally comprises a parking site for the third press nip fabric guide roll when the same is displaced from said intermediate frame.

14. The structure of claim 13, wherein said rear frame additionally comprises a parking site for another guide roll of the third press nip fabric.

15. The combination of claim 1, additionally comprising intermediate pieces mounted at respective servicing sides of said front and rear frames to be openable when replacing a closed press fabric loop.

16. The structure of claim 1, wherein dimension L of said space in the running direction between respective outermost rear and front edges of said front and rear frames respectively is larger than diameter D of a largest one of the press rolls.

17. The structure of claim 16, wherein $L=kD$ where $k=$about 1.1–2.0.

18. The structure of claim 17, wherein $k=$about 1.4 to 1.7.

19. The structure of claim 1, wherein service sides of said front and rear frames in the running direction are fully closed and nonopenable.

20. The structure of claim 1, additionally comprising a pivoting shaft through which said intermediate part is pivotally mounted upon said rear frame.

21. The combination of claim 1, wherein said central roll has a bearing pedestal, and further comprising a guide roll for a fabric passing through a press nip partially defined by said central roll, said guide roll being mounted upon an intermediate support in turn mounted upon the bearing pedestal of the central roll, and said guide roll being shiftable along a path of displacement through said open space to a parking site for the same, at an upper position, so that the fabric, guide roll, and central roll can be replaced.

22. The structure of claim 1, wherein one of said press rolls defines a first press nip with said central roll, a first fabric passing through said first press nip and serving to contact the web, a first set of guide rolls for guiding the first fabric, a second fabric arranged inside said first fabric and having a smaller loop than said first fabric, a second set of guide rolls for guiding said second fabric, said first and second set of guide rolls both being mounted n said front frame.

23. The structure of claim 1, wherein the central roll is mounted upon said intermediate frame with a center of rotation thereof situated, in the running direction, substantially in a middle area of said open space.

24. Frame structure for a press section of a paper machine, comprising, in a running direction of a paper web through the press section, a compact press roll combination, said compact press roll combination comprising a central roll and two other press rolls which each form a respective press nip with said central roll;

a front frame;

an intermediate frame having said central roll of said compact press roll combination mounted thereon; and a rear frame separate from said front frame, wherein a space is formed between said front and rear frames and above the press roll combination, said space being constantly at least partially open, or at least not permanently closed, such that respective ones of said press rolls of said press roll combination are accessible for removal from said paper machine, a lever element for openably interconnecting said front frame and said intermediate frame, said lever element being articulated to one of said front and intermediate frames so as to be pivotable between a closed operating position in which it interconnects said front and intermediate frames, and an open position in which it is disconnected from the other of said front and intermediate frames, such that an upper felt can be changed when said lever element is in said open position, said lever element having first and second projection parts structured to respectively fit into first and second mating parts of said front and intermediate frames, said lever element having a pivot joint located approximately midway between said first and second projection parts;

further comprising press rolls being mounted on said front and rear frames, at least some of which form said compact press roll combination.

25. The structure of claim 24, wherein said rear frame comprises a front part which directly supports said central roll of the press combination.

26. The structure of claim 24, wherein said rear frame comprises an intermediate member on a front portion thereof for supporting said central roll of the press combination.

27. The structure of claim 24, wherein said intermediate frame is connected to a front side of said rear frame.

28. The frame structure of claim 24, further comprising one or more eye bolts for maintaining said lever element in a closed position, said one or more eye bolts functioning, after they have been opened, to allow said lever element to be readily openable without any need for power devices to assist in opening said lever.

29. The frame structure of claim 24, wherein said compact press roll combination comprises a first press roll defining a first press nip with said central roll, a second press roll defining a second press nip with said first roll, and a third press roll defining another nip with said central roll, further comprising a plurality of bearing supports for respective loading arms of said third roll and a plurality of bearing supports for said center roll, said plurality of said bearing supports for said third roll each comprising a projection part which is coupled to respective mating parts for said bearing supports of said center roll;

a plurality of hydraulic cylinders which respectively load said loading arms such that said coupling of said projection part of said respective mating parts constitutes a hydraulic friction connection and wherein the power generated by said hydraulic cylinders is greater than the loading at said third nip; and a connecting element between said intermediate frame and said rear frame, and wherein said connecting element, said coupling of said projection parts to said respective mating parts, and said plurality of bearing supports for said center roll function to establish a closed circle in the region of said third nip such that vibration in said frame structure is substantially minimized.

30. The structure of claim 24, wherein said pivot joint has a substantially horizontal axis.

31. A press section of a paper machine, said press section comprising, in a running direction of a paper web through the press section;

a front frame, an intermediate frame having a central roll of a compact press roll combination mounted thereon; and a rear frame separate from and not permanently connected to said front frame, a plurality of press rolls mounted on said front and rear frames, at least some of which form said compact press roll combination in which there are press nips through which press fabric is passed, said compact press roll combination comprising said central roll and two other press rolls which each form a respective press nip with said central roll wherein a space is formed between said frames and above the press roll combination, said space being constantly at least partially open or at least not permanently closed such that respective ones of said press rolls of said press roll combination are accessible for removal from said paper machine, the press rolls of the press combination being replaceable through said space which also facilitates replacement of the press fabric, and one of said press rolls being mounted on an intermediate part separate from said front frame and pivotally mounted upon said rear frame at a rear part of said open space and being pivotable by an actuating device to an upper position for replacement of press rolls or fabric, said intermediate part extending above said one of said press rolls and terminating approximately in the same vertical plane as the front of said one of said press rolls when it is in a position forming one of said nips with said central press roll, a lever element for openably interconnecting said front frame and said intermediate frame, said lever element being articulated to one of said front and intermediate frames so as to be pivotable between a closed operating position in which it interconnects said front and intermediate frames, and an open position in which it is disconnected from the other of said front and intermediate frames, such that an upper felt can be changed when said lever is in said open position, said lever element having first and second projection parts structured to respectively fit into first and second mating parts of said front and intermediate frames, said lever element having a pivot joint located approximately midway between said first and second projection parts.

32. A press section of a paper machine, said press section comprising, in a running direction of a paper web through the press section;

a front frame, an intermediate frame having a central roll of a compact press roll combination mounted thereon; and a rear frame separate from and not permanently connected to said front frame, a plurality of press rolls mounted on said front and rear frames, at least some of which form said compact press roll combination in which there are press nips through which press fabric is passed, said compact press roll combination comprising said central roll and two other press rolls which each define a respective press nip with said central roll, one of said press rolls being mounted on an intermediate part separate from said front frame and pivotally mounted upon said rear frame, said intermediate part being pivotable between a operative position in which it extends above said one of said press rolls and terminates approximately in the same vertical plane as the front of said one of said press rolls, said one of said press rolls forming one of said nips with said central press roll and blocking the removal of said central roll when said intermediate part is in said operative position, said intermediate part being pivotable into an inoperative position wherein a space is formed between said frames and above said press roll combination, such that respective ones of said press rolls of said press roll combination are accessible for removal from said paper machine, and a lever element operably interconnecting said front frame and said intermediate frame, said lever element being articulated to one of said front and intermediate frames so as to be pivotable between a closed operating position in which it interconnects said front and intermediate frames, and an open position in which it is disconnected from the other of said front and intermediate frames, such that an upper felt can be changed when said lever is in said open position, said lever element having first and second projection parts structured to respectively fit into first and second mating parts of said front and intermediate frames, said lever element having a pivot joint located approximately midway between said first and second projection parts.

* * * * *